US011767738B1

(12) United States Patent
Altammar et al.

(10) Patent No.: US 11,767,738 B1
(45) Date of Patent: Sep. 26, 2023

(54) USE OF PRESSURE WAVE RESONATORS IN DOWNHOLE OPERATIONS

(71) Applicant: SAUDI ARABIAN OIL COMPANY, Dhahran (SA)

(72) Inventors: Murtadha J. Altammar, Dhahran (SA); Khalid Mohammed Alruwaili, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/066,789

(22) Filed: Dec. 15, 2022

(51) Int. Cl.
*E21B 43/00* (2006.01)
*E21B 37/00* (2006.01)
*E21B 43/26* (2006.01)

(52) U.S. Cl.
CPC ..... *E21B 43/003* (2013.01); *E21B 37/00* (2013.01); *E21B 43/26* (2013.01); *E21B 43/261* (2013.01)

(58) Field of Classification Search
CPC ..... E21B 43/003; E21B 37/00; E21B 43/26; E21B 43/261
See application file for complete search history.

(56) References Cited

U.S. PATENT DOCUMENTS

| | | | | |
|---|---|---|---|---|
| 9,243,477 | B2 | 1/2016 | Solenthaler | |
| 11,326,445 | B2 | 5/2022 | Malik et al. | |
| 2013/0146281 | A1 | 6/2013 | Noui-Mehidi et al. | |
| 2014/0305877 | A1* | 10/2014 | Cioanta | E21B 7/24 134/1 |
| 2015/0204177 | A1 | 7/2015 | Isangulov et al. | |
| 2019/0093457 | A1* | 3/2019 | Eng | E21B 43/26 |
| 2021/0071502 | A1* | 3/2021 | Gettis | E21B 43/003 |
| 2021/0301652 | A1* | 9/2021 | Zhang | E21B 43/26 |
| 2022/0178229 | A1 | 6/2022 | Alruwaili et al. | |
| 2022/0389793 | A1* | 12/2022 | Oettli | E21B 37/00 |

OTHER PUBLICATIONS

Ultrasonic Oil Well Stimulation Technology; retrieved from https://rexonics.com/ (2022).

Wang, X., Wang, X., Wang, J., & Tian, Z. (2020). Feasibility Study and Prospects of Rock Fragmentation Using Ultrasonic Vibration Excitation. Applied Sciences, 10(17), 5868.

Barma, S. D. (2019). Ultrasonic-assisted coal beneficiation: A review. Ultrasonics Sonochemistry, 50, 15-35.

Alghamdi, A. & Al-Qasim, Abdulaziz & Ayirala, S.. (2021). Low Carbon Foot-Print Reservoir Stimulation Technologies for Improved Oil Recovery. 1-13. 10.3997/2214-4609.202133080.

* cited by examiner

*Primary Examiner* — James G Sayre
(74) *Attorney, Agent, or Firm* — Vorys, Sater, Seymour and Pease LLP

(57) ABSTRACT

A wellbore stimulation operation method includes conveying a downhole assembly into a wellbore. The downhole assembly includes one or more perforating guns and a pressure wave resonator. The perforating guns are axially aligned with a production zone and fired to create a plurality of perforations in the production zone. The pressure wave resonator is axially aligned with the perforations and actuated to emit pressure waves that propagate radially outward and into the production zone. The pressure waves help remove debris from the perforations.

20 Claims, 9 Drawing Sheets

USE OF PRESSURE WAVE RESONATORS IN DOWNHOLE OPERATIONS

FIELD OF THE DISCLOSURE

The present disclosure relates generally to wellbore stimulation treatments and, more particularly, to the utilization of pressure wave-generating tools deployed in combination with downhole operations, such as plug and perforation stimulation operations.

BACKGROUND OF THE DISCLOSURE

In order to initialize and optimize hydrocarbon production from drilled oil and gas wells, it is often necessary to perform stimulation operations. Stimulation in horizontal wells, in particular, frequently includes multi-stage perforation and fracturing operations. As horizontal wells increasingly encompass longer lateral distances, wellbores traverse increasingly more reservoirs often requiring differing reservoir-specific stimulation treatments.

Operators utilize multi-stage well stimulation treatments to address reservoir specific needs and goals. To accomplish multi-stage operations, a commonly employed perforation technique known as "plug-and-perf" is often utilized. Plug-and-perf operations are deployed most often in cased, horizontal wells in which the operator wishes to fracture and induce production from multiple production zones or areas of the formation. Perforation and subsequent fracture treatment begins first in the deepest production zone. Once the deepest production zone is perforated and hydraulically fractured (or "Tracked"), a plug (e.g., a bridge or "frack" plug) is set to isolate that production zone from the next. The process continues until all the desired production zones have been perforated, fractured and mechanically isolated from one another with corresponding plugs. Once stimulation is complete, a milling assembly is deployed into the wellbore to mill each of the plugs allowing for unobstructed production through the wellbore.

As wells are continuing to be drilled to deeper and longer depths, improved and more efficient stimulation treatments are always desired.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore stimulation operation method may include conveying a downhole assembly into a wellbore that may include a production zone. The downhole assembly may include one or more perforating guns as well as a pressure wave resonator. The method may include axially aligning and then triggering operation of the perforating guns, thus creating a plurality of perforations in the production zone. The method may further include axially aligning and actuating the pressure wave resonator across the plurality of perforations. The pressure wave resonator may emit pressure waves that propagate radially outward into the production zone and thereby remove debris from the plurality of perforations with the pressure waves.

According to another embodiment consistent with the present disclosure, a wellbore stimulation operation method may include hydraulically fracturing a production zone of a wellbore and thereby creating micro-fractures in the production zone. The method may include reducing the fluid pressure within the wellbore and conveying a downhole assembly that includes a pressure wave resonator, into the wellbore. The pressure wave resonator may then be axially aligned with the production zone and then actuated. The pressure wave resonator may emit pressure waves that propagate radially outward and into the micro-fractures, thereby removing debris from the micro-fractures with the pressure waves.

According to another embodiment consistent with the present disclosure, a downhole assembly utilized for a wellbore stimulation operation, may include one or more perforating guns operatively coupled to a pressure wave resonator. The downhole assembly may be conveyable by some means of conveyance into a wellbore so as to axially align the perforating gun(s) with a production zone and upon triggering the perforating gun(s), may create a plurality of perforations in the production zone. Further, the pressure wave resonator may be axially alignable with the plurality of perforations and configured to emit pressure waves that propagate radially outward and into the production zone to remove debris from the plurality of perforations.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
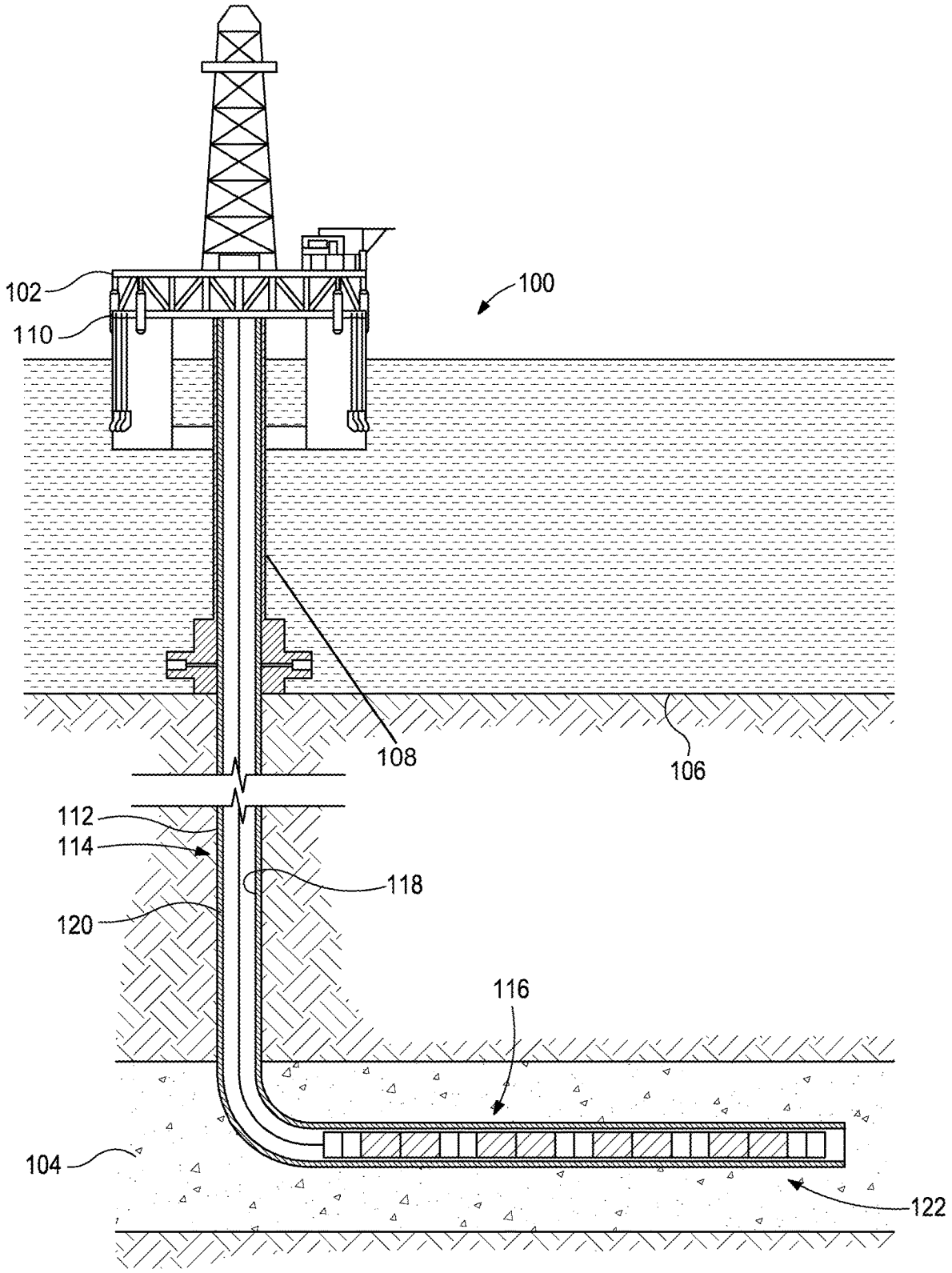
FIG. 1 is a schematic diagram of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to wellbore stimulation treatments. In particular, the present disclosure describes the use of a pressure wave-producing tool deployed in conjunction with a "plug-and-perf" downhole assembly for stimulating hydrocarbon-producing wells. The embodiments described herein can be advantageous in helping to remedy potential abandonment of planned fracture stages when formation breakdown pressure is found to be high (or abnormally high) and as such, difficult to hydraulically fracture. Additionally, the employment pressure wave generators for near wellbore stimulation can help avoid the use of certain fluid injection treatments (e.g. acid chemicals) that are often difficult to place and may be damaging and dangerous to the environment and the operators who handle them.

Well stimulation is common practice whether utilized to initialize first hydrocarbon production or enhance hydrocarbon production later in the life of a well. In all cases, the goal of stimulation treatment is to improve the permeability of the formation so that hydrocarbon production may be maximized efficiently. Formation permeability pertains to the connectivity of the naturally occurring pore spaces within the formation. Permeability is a measure of a formation's ability to convey fluid through its pore spaces. In certain formations, the porosity of the subterranean rock may be high, but the permeability of the formation may be low. Hydrocarbons may be trapped within the pore spaces but due to the formation's low permeability cannot be accessed by means of conventional drilling and completion techniques. For this reason well stimulation operations are performed to increase permeability so as to enhance potential hydrocarbon travel through the formation and into the wellbore for production to surface.

Generally, well stimulation treatments are classified as either matrix or fracturing treatments. Matrix stimulation treatments commonly entail pumping a chemical or acid across the zone of interest (also known as the production zone or treatment zone) at a pressure below which would fracture the formation. Alternatively, a fracturing stimulation treatment requires the pumping of a predesigned fluid into the zone of interest at a high rate and pressure above which would fracture the formation. In the case of hydraulic fracturing, a fracture fluid is pumped into the formation exerting a pressure that causes the formation to fracture or crack. As the hydraulic fluid is pumped, material entrained within the fluid (known as proppant) propagates into the generated fractures. Once the applied pump rate and pressure are released and the hydraulic stimulation is complete, the proppant remains within the imposed fractures. Upon the release of the applied pump rate and pressure, the formation will attempt to return to its undisturbed state. However, the proppant serves as a means to keep the induced fracture open. This generation of proppant propagated fractures increases the potential of hydrocarbon flow to the wellbore, increasing the permeability of the formation and more particularly, the zone of interest. Additionally, the introduction of proppant filled fractures affects the near wellbore fracture conductivity of the wellbore. Fracture conductivity being a measure of a fluids ability to be flow from the formation, through the fractures propagated by proppant and into the wellbore.

Well stimulation techniques employed in horizontal wells frequently include multi-stage perforation and hydraulic fracturing treatments where the operator wishes to perform the stimulations in discrete sections or stages and where there are multiple zones of interest throughout the wellbore. Often such treatments occur immediately upon conclusion of the drilling operations in order to stimulate immediate hydrocarbon production. To accomplish multi-stage operations, a commonly employed perforation technique which is known throughout the industry as "plug-and-perf," is utilized.

Implementation of plug-and-perf operations on a newly drilled, cased, and cemented well, may consist of first performing a clean out run to remove any residual cement from the interior walls of the installed casing. Once cleaned out, a perforating assembly, including some configuration of perforating guns, will be deployed downhole by means of wireline or coiled tubing. Treatment begins first in the deepest portion of the wellbore. The perforating assembly is deployed within the wellbore and positioned so that the perforating guns may be detonated into the deepest zone of interest (i.e., the zone farthest from the surface). Depending upon the construction of the completed wellbore, the perforating guns are positioned such that upon detonation, they will perforate through the wellbore tubing, casing, cement, and into the formation. Following perforation of the deepest zone, the perforating assembly is removed from the wellbore so that the fracturing operation may commence. In most cases, and particularly for horizontal wells drilled in unconventional formations, fracturing occurs by hydraulic means. As mentioned above, a fluid containing a reservoir-specific proppant is pumped into the wellbore at predetermined pressure and rates. The fluid (with proppant) enters the perforated zones, and due to the applied hydraulic pressure, induces fractures or micro-fractures (or fissures) that extend outwardly from the perforations. Once the hydraulic pressure is reduced, the induced fractures will compress and attempt to close. However, because the hydraulic fluid contains proppant, the fractures are held open, ideally resulting in increased permeability and increased near wellbore fracture conductivity.

In continuing the operation, after hydraulically fracturing the deepest perforations, a plug-and-perf assembly consisting of a composite material plug (composite so that it may be drilled and/or milled later), a plug setting tool, and a perforating apparatus (alternatively referred to as "perforating guns" or "perf guns"), is deployed downhole. The plug is positioned and set some predetermined distance above (uphole from) the shallowest perforation. The plug serves as a mechanical means of separation between the deepest zone of interest and the zone immediately preceding it. Upon setting and releasing the plug setting tool from the plug, the assembly (now consisting of perforating guns atop the plug setting tool) is deployed upward and in the opposite direction of the plug so as to position the perforating guns across the next desired zone (i.e., next deepest) of interest. The perforating guns are detonated and perforate the tubing, casing, cement, and adjacent portions of the surrounding formation. Following perforation, the perforating assembly is removed from the wellbore so that the hydraulic fracture treatment may commence at the newly perforated zone of interest. The procedure continues until the pre-determined number of stages and zones have been treated and isolated. Once operationally efficient, a milling assembly is then deployed into the treated wellbore to mill out the composite plugs and thereby permit unobstructed flow through the wellbore. With an unobstructed flow path, the wellbore is ready to be brought on for initial production.

Permeability in a wellbore is crucial to both initial well production and to production over the life of a well. As briefly mentioned, permeability is the measure of the formation's ability to convey fluid through its pore spaces and as such, represents the efficiency with which hydrocarbons can flow through the formation and into the wellbore. Overtime, damage to the induced fractures within the near wellbore region may result in a loss of permeability and thus, a reduction in hydrocarbon production. Damage may be incurred naturally (as a result of hydrocarbon flow from the producing reservoir) or similarly may be induced (as a result of well interventions, workover operations, and/or some stimulation treatments). Whether naturally incurred or otherwise, damage to the formation and fractures within the near wellbore region of the well may include clay swelling, fines migration, scale formation, and clogging due to paraffin, wax, asphaltenes, and similar. Hydrocarbon-producing wells (whether initially stimulated to begin production or not) will, in most cases, require stimulation treatments at some point in their life cycle.

As discussed, methods of stimulation to cure near wellbore damage or to improve both permeability and fracture conductivity include matrix stimulation and hydraulic fracturing. Alternatively, or in addition thereto, the use of pressure wave-generating tools, such as high-power ultrasound technology, may be utilized to increase permeability. Ultrasound resonance tools, for example, can be used in the oil and gas industry to stimulate wells that are substantially within their production life. In such cases, ultrasound or "ultrasonic" treatments are performed to enhance or return production to their initial levels. Stimulation treatments require positioning an ultrasonic tool (alternatively referred to as a "resonator") across a damaged producing zone of interest. Once positioned, the resonator excites the zone by generating acoustic waves that invade the formation at a frequency reaching to and matching the natural frequency of the formation. Upon reaching the formation's natural frequency (i.e., resonance) the rock formation will begin to vibrate and oscillate. This naturally induced vibration serves to potentially clear debris clogged pores spaces and fractures in the damaged near wellbore region. Additionally, the exposure to excitation may cause the formation to fatigue and crack, inducing new micro-fractures in the near wellbore region. With continued exposure, fractures may continue to propagate beyond the near wellbore region. Successful ultrasonic resonation should ultimately increase permeability and near wellbore conductivity.

Pressure wave stimulation has generally been confined to post-production treatments often years into the well life cycle, in an attempt to return production to its pre-near wellbore formation damaged levels. Advantageously, embodiments described herein utilize pressure wave treatment before oil and gas production begins, as a means of pre-production stimulation. More particularly, the methods and systems described herein will provide a means to condition the near-wellbore region of the zone of interest prior to hydraulic fracturing. Furthermore, the methods and systems described herein will provide a means to improve near-wellbore conductivity and connectivity immediately after hydraulic fracturing operations.

FIG. 1 is a schematic diagram of an example well system 100 that may embody or otherwise employ one or more principles of the present disclosure. In the illustrated embodiment, the well system 100 includes an offshore oil and gas platform 102 centered over a submerged oil and gas formation 104 located below a seafloor 106. Even though FIG. 1 depicts an offshore oil and gas platform 102, it will be appreciated by those skilled in the art that the various embodiments discussed herein are equally well suited for use in conjunction with other types of oil and gas rigs, such as land-based oil and gas rigs or rigs located at any other geographical site. A subsea conduit 108 extends from a deck 110 of the platform 102 to the seafloor 106.

As depicted, a wellbore 112 extends through the various earth strata including the formation 104. The wellbore 112 has an initial, generally vertical portion 114 and a lower, generally deviated or horizontal portion 116. In some embodiments, a string of casing 118 is cemented within the wellbore 112 using cement 120 and extends laterally into the horizontal portion 116. In other embodiments, however, a portion of the wellbore 112 may comprise open-hole where the casing 118 is omitted.

The system 100 further includes a downhole assembly 122 extendable into the wellbore 112 on a conveyance 124. In some embodiments, the conveyance 124 may comprise wireline or "slickline," but could alternatively comprise coiled tubing, drill pipe, or any combination thereof. The downhole assembly 122 (hereinafter referred to as the "assembly 122") may include various tools, devices and systems configured to undertake a number of wellbore stimulation operations, such as a plug-and-perf operation as generally described herein. While the assembly 122 is shown arranged within the horizontal portion 116 of the wellbore 112, the embodiments described herein are equally applicable for use in the vertical portion 114 or any deviated or slanted portions of the wellbore 112, without departing from the scope of the disclosure.

Figure 2:
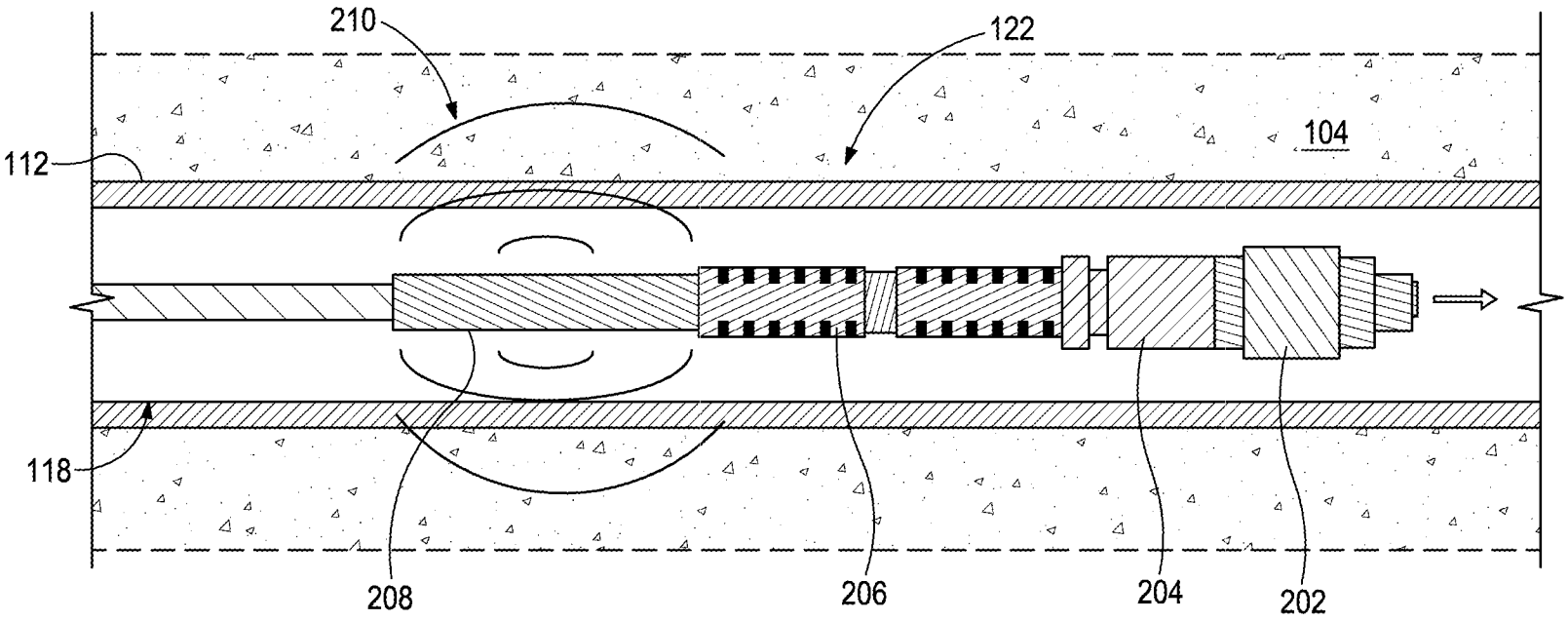
FIG. 2 is a schematic, cross-sectional side view of a wellbore interposed by a pressure wave resonator assembly according to one or more embodiments of the present disclosure.

FIG. 2 is an enlarged schematic side view of at least one example of the downhole assembly 122, according to one or more embodiments. As illustrated, the assembly 122 may include a plug 202, a plug setting tool 204, one or more perforating guns 206, and a pressure wave resonator 208. The plug 202 may be configured to be axially secured within the casing 118 and thereby isolate uphole and downhole portions of the wellbore 112. In some cases, the plug 202 may be composed of a soft material (e.g., soft metals, composite materials, polymers, etc.) so that it may be drillable (or millable) when operationally desired. In other cases, the plug 202 may be composed of a dissolvable material, thus eliminating the need for subsequent drilling or milling.

The plug 202 may be operatively coupled to the plug setting tool 204, which is configured to deploy (actuate) the plug 202 at a desired location within the wellbore 112 and thereby secure the plug 202 against the inner radial surface of the casing 118. The plug 202 may include a plurality of slips (not shown) having hardened edges that latch or "bite" into the inner radial surface of the casing 118 upon actuation. Moreover, the plug 202 may also include an expandable rubber or elastomeric element configured to radially expand upon actuation to sealingly engage the inner radial surface of the casing 118. The resultant sealed interface isolates portions of the wellbore 112 uphole and downhole of the plug 202.

In the illustrated embodiment, the perforating gun(s) 206 are arranged uphole from and operatively coupled to the plug setting tool 204, but could alternately be positioned at other locations along the assembly 122, without departing from the scope of the disclosure. In example operation, the perforating gun(s) 206 may be strategically positioned at a desired location within the wellbore 112 and actuated (triggered, fired, etc.) to generate a plurality of perforations (not shown) in the casing 118. In embodiments where the casing 118 is omitted (e.g., an open-hole wellbore), the perforations will be defined in the inner radial surface of the wall of the wellbore 112. The resulting perforations provide conduits through which hydrocarbons (e.g., oil and gas) can migrate into the wellbore 112 for production. While FIG. 2 depicts two perforating guns 206, the number of perforating guns 206 is not limited to two and may instead be designed and configured to accommodate the specific needs of the wellbore 112.

The pressure wave resonator 208 may be arranged uphole from the perforating gun(s) 206, as illustrated, but could alternatively be arranged downhole from the perforating gun(s) 206, without departing from the scope of the disclosure. The pressure wave resonator 208 may house and otherwise include various internal devices or mechanisms (not shown) capable of generating energy or "pressure" waves 210 that can be emitted radially outward and towards the surrounding subterranean formation 104. The pressure waves 210 can be in the form of any propagating energy wave, such as sound waves, fluid energy waves, shock waves, or any combination thereof. In at least one embodiment, for example, the pressure wave resonator 208 may be configured to emit high-power ultrasonic or ultrasound sound waves at a frequency of 20 Hz or greater. In other embodiments the pressure wave resonator 208 may be configured to emit sound waves at a lower frequency in accordance with the needs of the formation 104. In yet other embodiments, the pressure wave resonator 208 may be configured to emit pressure pulses by means of dynamic water injection.

The pressure wave resonator 208 may comprise any device, mechanism, or generator capable of producing pressure waves 210 at desired frequencies. In at least one embodiment, the pressure wave resonator 208 may comprise a plasma pulse device. Actuation of the pressure wave resonator 208 comprising a plasma pulse device occurs when a plasma arc, created by generated electrical charges stored within the capacitor of the tool, discharges large amounts of heat and pressure in short increments of time (e.g. fraction of a second). This intermittent momentary release of energy generates heated shock waves at frequencies most often between 1 Hz to 20 kHz) that emanate radially outward. Other examples of the pressure wave generator 208 include, but are not limited to, a pressure pulse generator, an ultrasound generator, and a high-pulse power generator. A pressure pulse generator produces pressure waves 210 by emitting cavitating fluid pulses into the formation 104; in most cases, the fluid being water. An ultrasound generator may produce pressure waves 210 in the form of acoustic or sound waves at ultrasonic frequencies (e.g. 20 kHz and higher). Further, a high-pulse power generator may produce pressure waves 210 by rapidly emitting stored electrical energy in a series of stages, with each stage growing in power.

FIGS. 3-8 are enlarged schematic side views of a portion of the wellbore 112 depicting the progressive steps of an example wellbore stimulation operation according to one or more embodiments of the present disclosure. As illustrated, the wellbore 112 includes at least two production zones of interest, more particularly, a first production zone 302 (e.g., a zone of interest closest to the total depth of the wellbore 112) and a second production zone 304 (e.g., a zone of interest located uphole from the first production zone 302. As depicted, production zones 302 and 304 are positioned within the formation 104, and while only two production zones 302, 304 are shown, more than two zones may be treated using the methods and systems described herein. Moreover, the operations depicted in FIGS. 3-8 are generally undertaken within the horizontal portion 116 of the wellbore 112, but could alternatively be undertaken in the vertical portion 114, without departing from the scope of the present disclosure.

Figure 3:
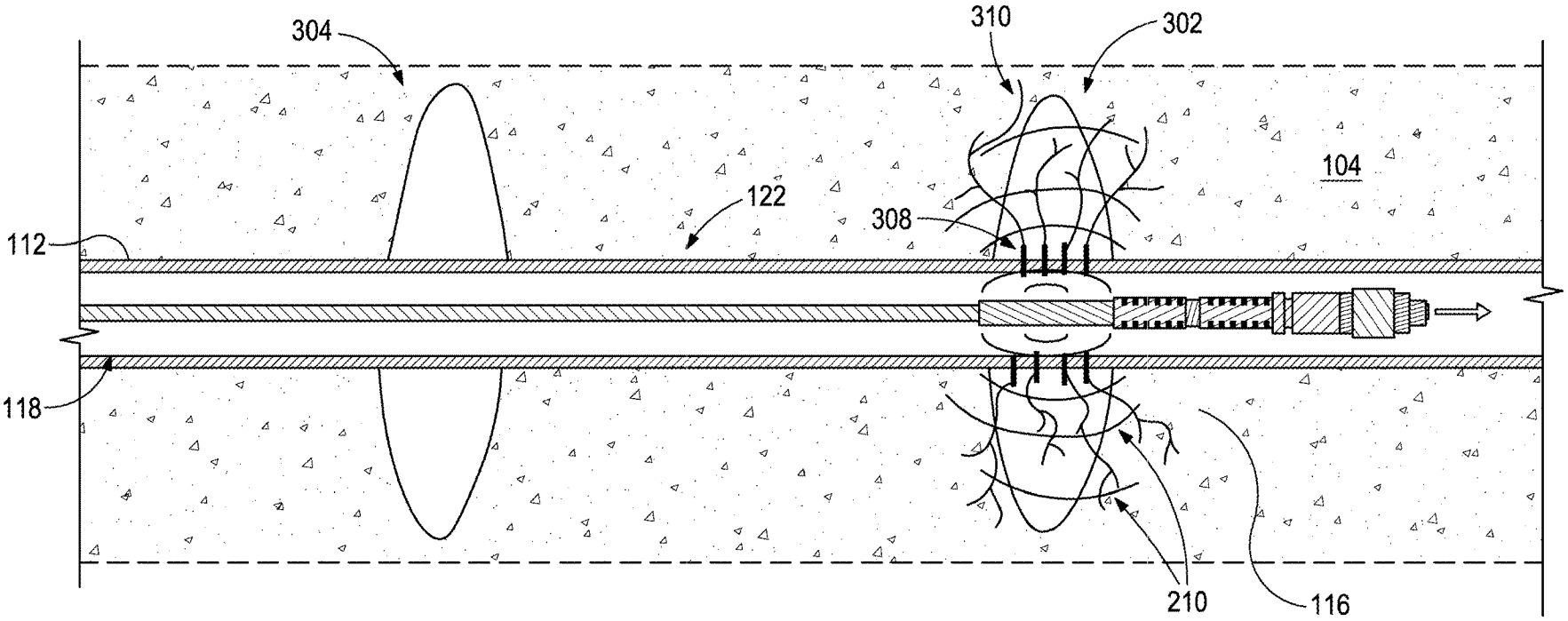
FIGS. 3-8 are enlarged schematic side views of a portion of the wellbore of FIG. 1 depicting the progressive steps of an example wellbore stimulation operation, according to one or more embodiments of the present disclosure.

Referring first to FIG. 3, depicted is an enlarged schematic side view of the portion of the wellbore 112 depicting treatment of the first production zone 302. As illustrated, the first production zone 302 has been previously perforated and stimulated, and thus includes a plurality of perforations 308 defined through the casing 118, and a plurality of fractures 310 (also referred to as "micro-fractures") extend radially outward from the perforations 308 and into the surrounding subterranean formation 104.

As depicted, the assembly 122 may be positioned so that the pressure wave resonator 208 is arranged within the wellbore 112 to axially align with the first production zone 302. Once aligned with the first production zone, the pressure wave resonator 208 may be operated (actuated) to emit pressure waves 210 that acoustically stimulate the perforations 308 and fractures 310 of the first production zone 302. The propagation of the pressure waves 210 (e.g., high-power ultrasound waves, fluid energy waves, shock waves, etc.) into the formation 104 and, more particularly, into the perforations 308 of the first production zone 302 may induce resonance that will result in the surrounding rock formation vibrating and oscillating. In some embodiments, the pressure waves 210 may be emitted from the pressure wave resonator 208 at a frequency that matches the natural frequency of the formation 104. Upon reaching resonance, the natural excitation and vibration of the formation 104 may serve to clear potentially clogged perforations 308 from debris generated by the perforating operations themselves, or otherwise. Resonance may also help clear potentially clogged pore spaces in the formation 104 resulting from drilling fluid or "mud" damage incurred during prior drilling operations. Accordingly, the term "debris" as used herein can refer to material or remains from prior drilling or perforating operations. Moreover, as the formation 104 reaches resonance, additional near wellbore fractures may be induced by the pressure wave resonator 208 activation, thereby further increasing permeability.

Figure 4:
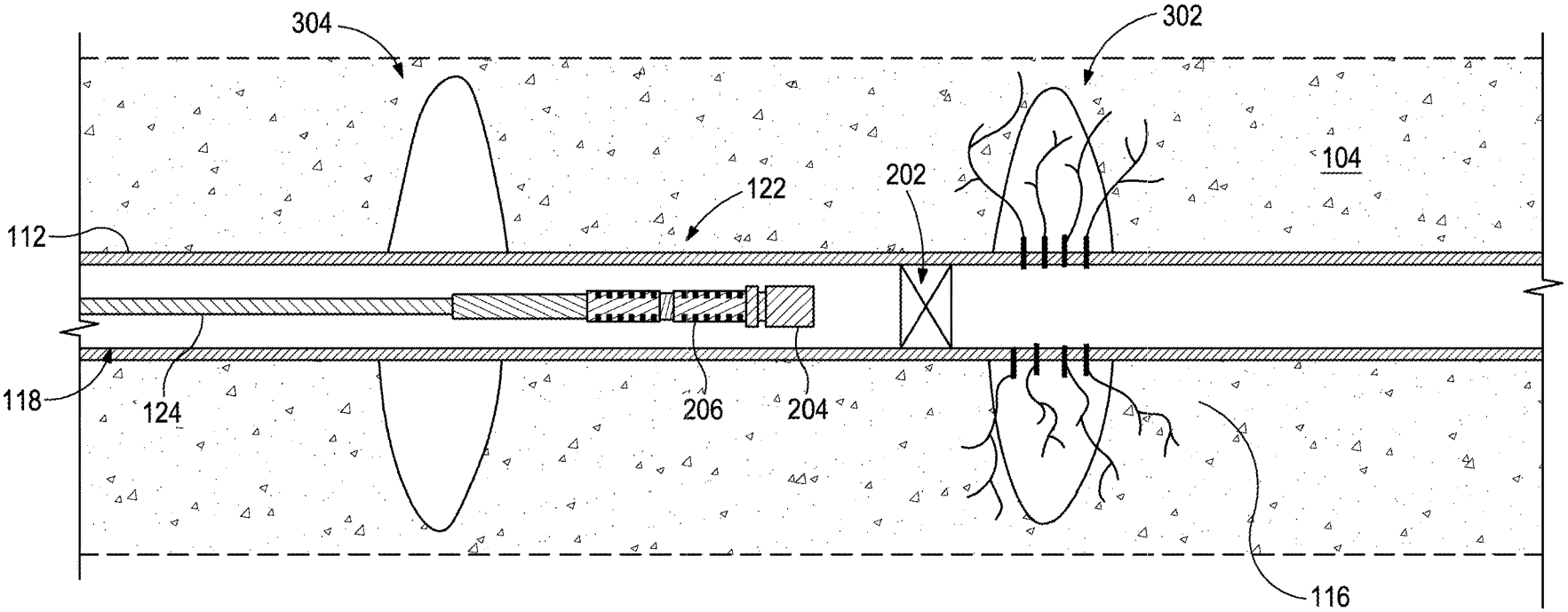

FIG. 4 depicts a next progressive step of the example wellbore stimulation operation, according to one or more embodiments. More specifically, following pressure wave stimulation of the first production zone 302, the assembly 122 may be pulled uphole within the casing 118 by retracting the conveyance 124 such that the plug 202 of the assembly 122 may be positioned above (uphole from) the first production zone 302. Once properly positioned, the plug 202 may be set within the casing 118 using the plug setting tool 204, as generally described above, and thereby isolate uphole and downhole portions of the wellbore 112.

Once the plug 202 is successfully set within the casing 118, the plug setting tool 204 disengages from the plug 202. In some applications, an axial load is applied on the conveyance 124, which transmits a shear force to decouple the plug setting tool 204 from the plug 202. Once decoupled, the plug setting tool 204, in combination with the perforating guns 206 and the pressure wave resonator 208, may be moved to another location within the wellbore 112 to continue with the wellbore stimulation operation.

Figure 5:
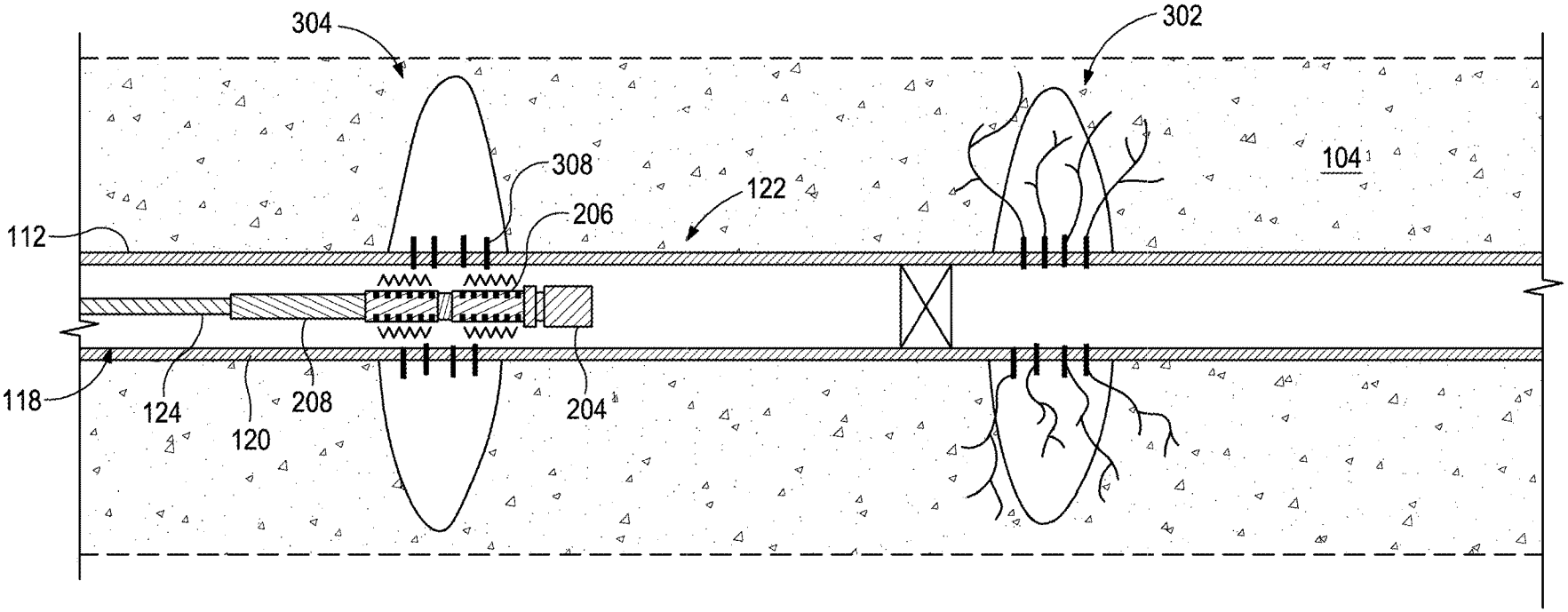

FIG. 5 depicts a next progressive step of the example wellbore stimulation operation, according to one or more embodiments. More specifically, the assembly 122 (now including the plug setting tool 204, the perforating guns 206, and the pressure wave resonator 208) may be pulled uphole to axially align the perforating guns 206 with the second production zone 304. Once properly aligned, the perforating guns 206 may be triggered (detonated). On detonation, shaped explosive charges create perforations 308 in the adjacent casing 118 and extend radially outward through the cement 120 and into surrounding portions of the formation 104. The resulting perforations 308 provide conduits that allow fluid communication between the formation 104 and the wellbore 112.

Figure 6:
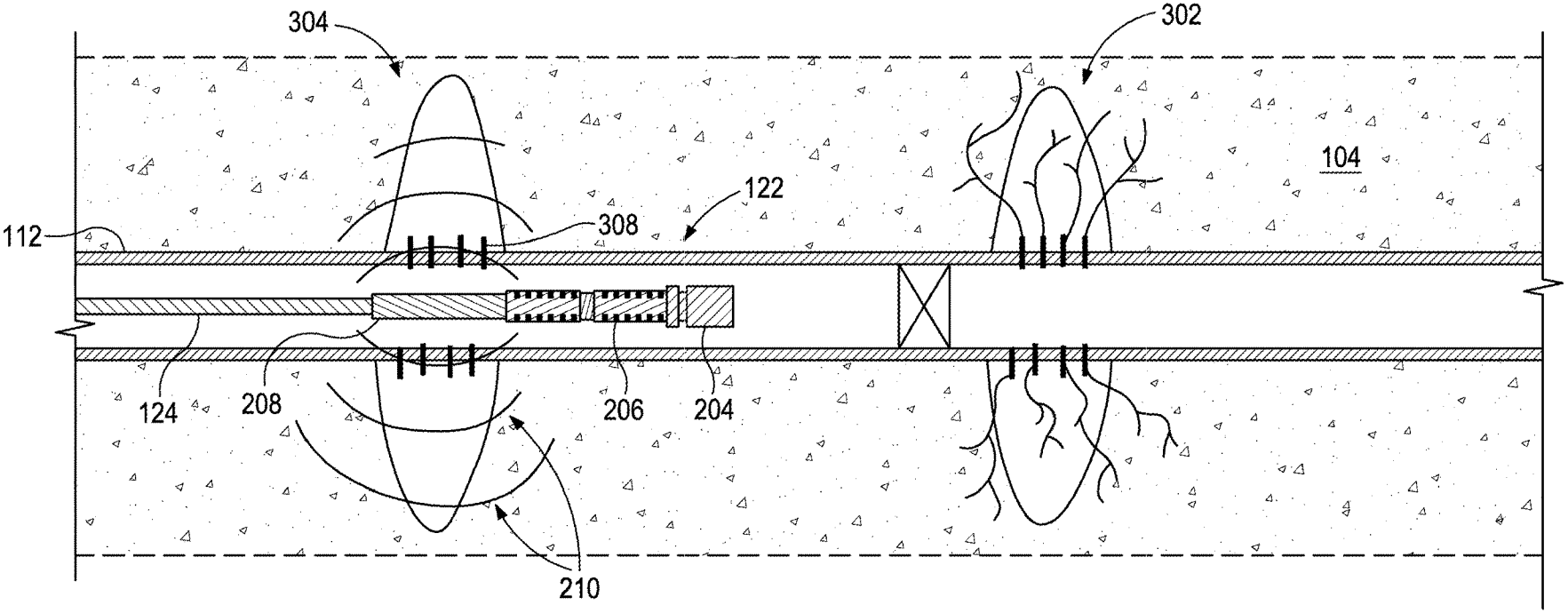

FIG. 6 depicts a next progressive step of the example wellbore stimulation operation, according to one or more embodiments. More specifically, following perforation of the second production zone 302, the assembly 122 may be re-positioned within the wellbore 112 such that the pressure wave resonator 208 may be axially aligned with the second production zone 304 and, therefore, aligned with the newly created perforations 308. The pressure wave resonator 208 may then be actuated (operated) so as to stimulate the perforations 308 by propagating pressure waves 210 into the second production zone 304. The pressure waves 210 may help remove any debris that may be clogging the perforations 308 as a result of the preceding perforating operation. Once stimulation of the zone 304 perforations 308 is complete, the assembly 122 may be removed from the wellbore 112 and back to surface by retracting the conveyance 124 so as to clear the wellbore 112 of any downhole tools.

Figure 7:
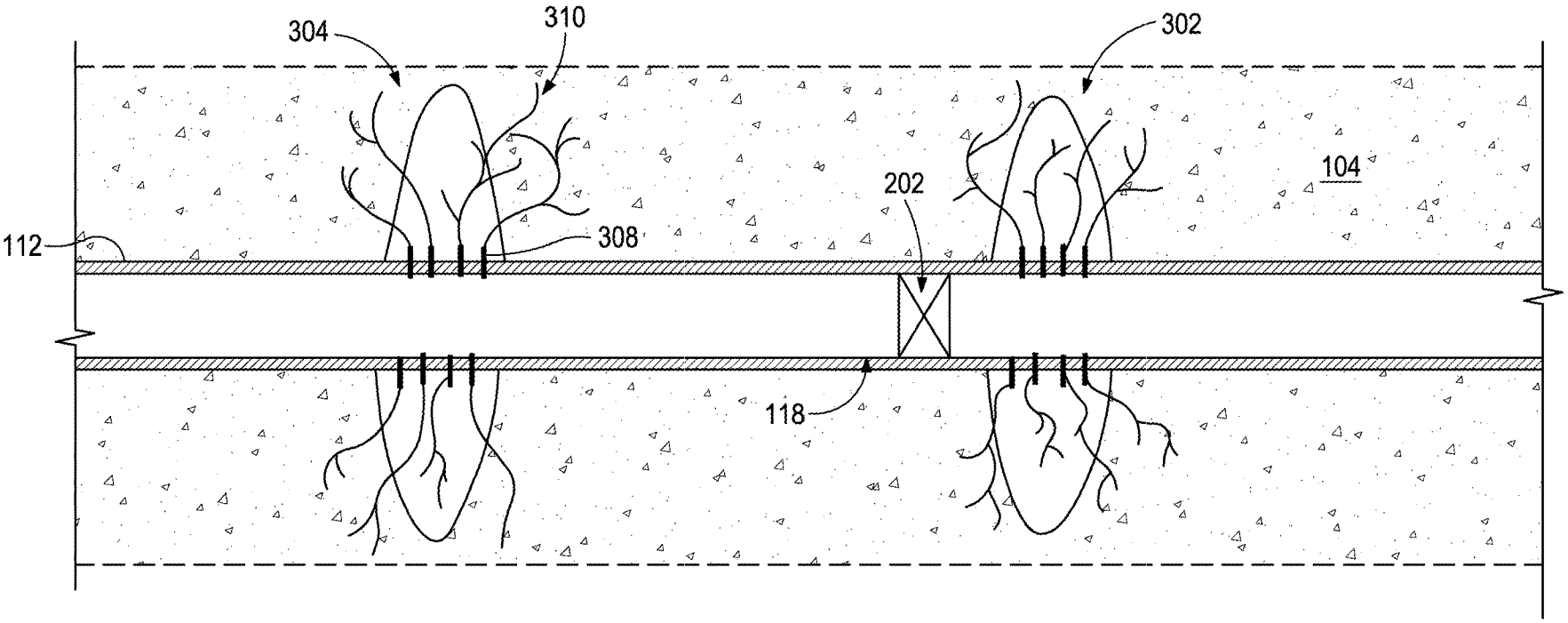

FIG. 7 depicts a next progressive step of the example wellbore stimulation operation, according to one or more embodiments. As depicted, the assembly 122 is removed from the wellbore 112, and upon removal, the second production zone 304 may be further stimulated by undertaking a hydraulic fracturing treatment to induce fracture conductivity and increase permeability. In some embodiments, instead of a hydraulic fracturing treatment, other means of stimulation known by those of ordinary skill in the art may be implemented. As described above, hydraulic fracturing operations include pumping a proppant-enhanced (laden) hydraulic fluid into the wellbore 112. In the present example, the plug 202 sealingly engages the interior walls of the casing 118 and creates a fluid dam that prevents the hydraulic fluid from flowing beyond the plug 202 and into downhole portions of the wellbore 112. Rather, the hydraulic fluid is hydraulically forced into the perforations 308 of the second production zone 304, thus inducing a plurality (network) of micro-fractures 310 extending radially outward from the wellbore 112. When the fluid pressure of the hydraulic fluid is reduced, the micro-fractures 310 may remain as propagated by the proppant.

Figure 8:
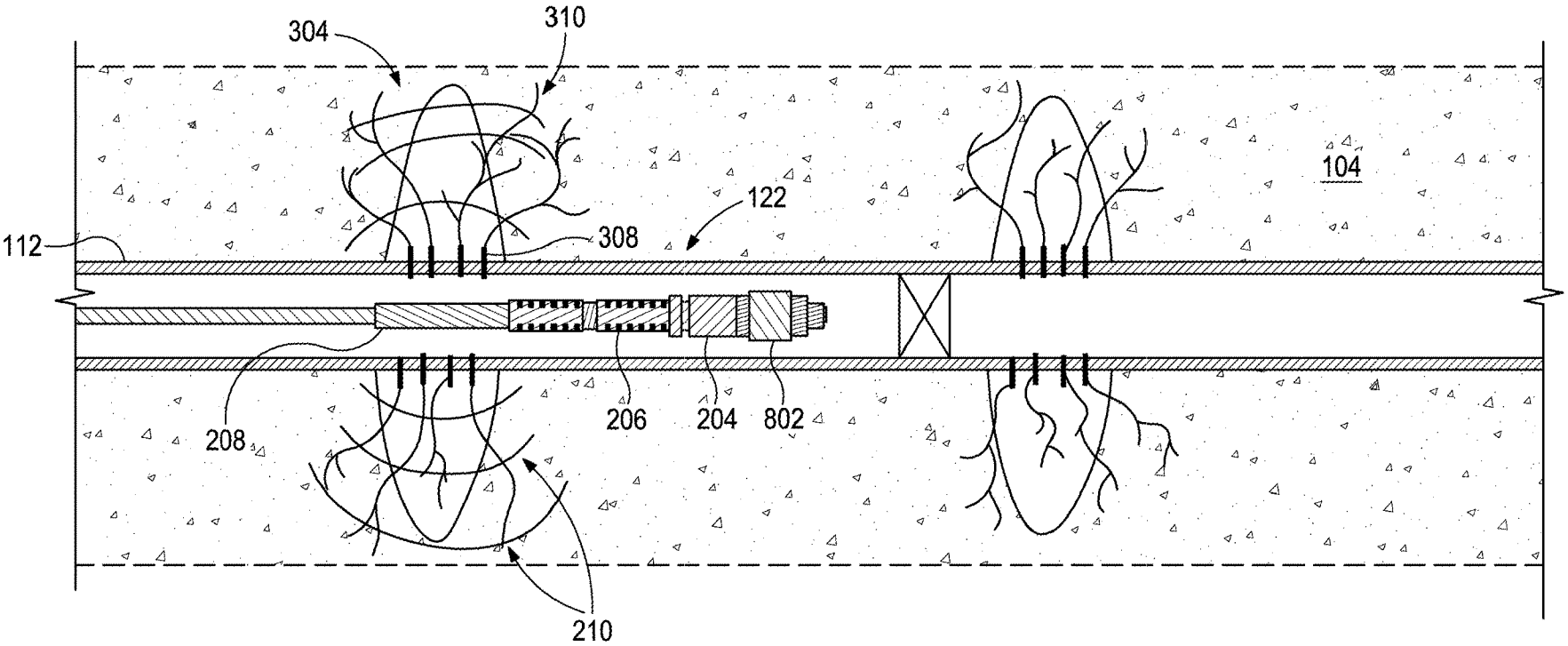

FIG. 8 depicts a next progressive step of the example wellbore stimulation operation, according to one or more embodiments. Once the perforations 308 of the second production zone 304 have been hydraulically fractured, the assembly 122 may be reintroduced into the wellbore 112 on the conveyance 124. As illustrated, the assembly 122 includes the plug setting tool 204, the one or more perforating guns 206, the pressure wave resonator 208, and further includes a new or "second" plug 802 operatively coupled to the plug setting tool 204.

The assembly 122 may be positioned such that the pressure wave resonator 208 is axially aligned with the now hydraulically stimulated perforations 308 of the second production zone 304. As a result of the hydraulic fracture treatment itself, the hydraulically induced micro-fractures 310 may be clogged by debris. Crushed granules of ineffective proppant may clog the induced micro-fractures 310 within the near wellbore region. Similarly, rock fragments resulting from hydraulic fracturing may act as a hindrance to fracture conductivity and hydrocarbon flow when the well is brought on to production. As such, the pressure waves 210 emitted by the pressure wave resonator 208 may help to clear any debris clogging both the perforations 308 and the micro-fractures 310 as the formation 104 reaches its natural resonance Following pressure wave stimulation of the second production zone 304 (post-hydraulic fracture), the operational steps to set the second plug 802 may be completed in the same manner explained above in setting the first plug 202.

The procedural steps of the foregoing wellbore stimulation operation disclosed and illustrated in FIGS. 3-8 may then be repeated as many times as operationally desired. Additionally, the order of operations disclosed in the present embodiment should not be considered limiting. It will be understood by those in the art that the changes to the order of operations may be modified so as to be operationally efficient to the wellbore 112.

Figure 9:
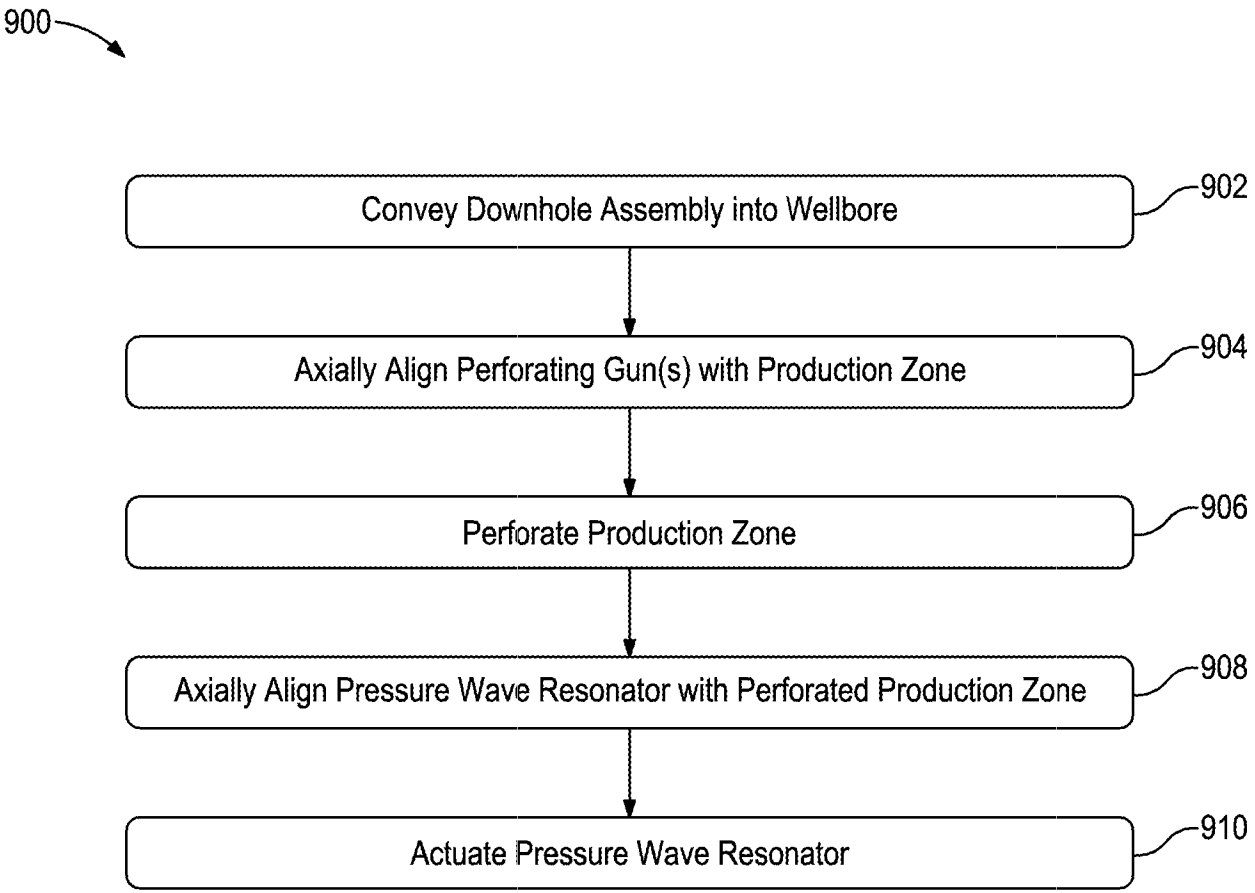
FIG. 9 is a schematic flowchart of an example wellbore stimulation operation method, according to one or more embodiments.

FIG. 9 is a schematic flowchart of an example wellbore stimulation operation method 900, according to one or more embodiments. The method 900 may include conveying a downhole assembly into a wellbore, as at 902. The wellbore includes at least one production zone and, in some embodiments, may be lined with casing. In other embodiments, however, the wellbore may comprise an open-hole wellbore, without departing from the scope of the disclosure. The downhole assembly may include one or more perforating guns and a pressure wave resonator. The method 900 may further include axially aligning the one or more perforating guns with a production zone, as at 904. The perforating guns may then be triggered (detonated) to create one or more perforations in the production zone, as at 906. The pressure wave resonator may then be axially aligned with the resulting perforations, as at 908. Lastly, the method 900 may additionally include actuating the pressure wave resonator resulting in the emittance of pressure waves propagating radially outward and into the one or more perforation(s), as at 910, thereby removing debris from the perforation(s) with the pressure waves and potential resultant formation resonance.

Embodiments disclosed herein include:

A. A wellbore stimulation operation method includes conveying a downhole assembly into a wellbore including a production zone, the downhole assembly including one or more perforating guns and a pressure wave resonator. The method further including axially aligning the one or more perforating guns with the production zone, triggering operation of the one or more perforating guns and thereby creating a plurality of perforations in the production zone. The method, additionally including, axially aligning the pressure wave resonator with the plurality of perforations, actuating the pressure wave resonator and thereby emitting pressure waves that propagate radially outward and into the production zone, and removing debris from the plurality of perforations with the pressure waves.

B. A wellbore stimulation operation method includes hydraulically fracturing a production zone of a wellbore and thereby creating micro-fractures in the production zone, reducing a fluid pressure within the wellbore and subsequently conveying a downhole assembly including a pressure wave resonator into the wellbore. The method further includes axially aligning the pressure wave resonator with the production zone, actuating the pressure wave resonator and thereby emitting pressure waves that propagate radially outward and into the micro-fractures, and removing debris from the micro-fractures with the pressure waves.

C. A downhole assembly for undertaking a wellbore stimulation operation includes one or more perforating guns and a pressure wave resonator operatively coupled to the one or more perforating guns. Wherein the downhole assembly is conveyable into a wellbore on a conveyance to axially align the one or more perforating guns with a production zone to create a plurality of perforations in the production zone. Further, wherein the pressure wave resonator is axially alignable with the plurality of perforations and configured to emit pressure waves that propagate radially outward and into the production zone to remove debris from the plurality of perforations.

Each of embodiments A, B, and C may have one or more of the following additional elements in any combination: Element 1: further comprising: removing the downhole assembly from the wellbore; fracturing the production zone via the plurality of perforations and thereby inducing micro-fractures in the production zone; reintroducing the downhole assembly into the wellbore; axially aligning the pressure wave resonator with the production zone; actuating the pressure wave resonator and thereby emitting pressure waves that propagate radially outward and into the micro-fractures; and removing debris from the micro-fractures with the pressure waves. Element 2: wherein the production zone is a first production zone and the downhole assembly further includes a plug arranged at a distal end of the downhole assembly and operatively coupled to a plug setting tool, the method further comprising: moving the downhole assembly uphole from the first production zone; actuating the plug setting tool and thereby setting the plug within the wellbore uphole from the first production zone; axially aligning the one or more perforating guns with a second production zone included in the wellbore; triggering operation of the one or more perforating guns and thereby a creating plurality of perforations in the second production zone; axially aligning the pressure wave resonator with the plurality of perforations of the second production zone; actuating the pressure wave resonator and thereby emitting pressure waves that propagate radially outward and into the second production zone; and removing debris from the plurality of perforations of the second production zone with the pressure waves. Element 3: wherein setting the plug within the wellbore isolates the second production zone from the first production zone. Element 4: wherein the wellbore is lined with casing and creating the plurality of perforations in the production zone comprises defining the plurality of perforations in the casing. Element 5: wherein the wellbore is an open-hole wellbore and creating the plurality of perforations in the production zone comprises defining the plurality of perforations in an inner wall of the wellbore. Element 6: wherein actuating the pressure wave resonator comprises emitting ultrasound pressure waves at a frequency of 20 Hz or greater. Element 7: wherein the pressure wave resonator is selected from the group consisting of a plasma pulse device, a pressure pulse generator, an ultrasound generator, and a high-pulse power generator, and any combination thereof. Element 8: wherein conveying the downhole assembly into the wellbore comprises, conveying the downhole assembly into the wellbore on a conveyance selected from the group consisting of wireline, slickline, coiled tubing, production tubing, and any combination thereof.

Element 9: wherein the production zone is a first production zone and the downhole assembly further includes a plug arranged at a distal end of the downhole assembly and operatively coupled to a plug setting tool, and one or more perforating guns, the method further comprising: moving the downhole assembly uphole from the first production zone; actuating the plug setting tool and thereby setting the plug within the wellbore uphole from the first production zone; axially aligning the one or more perforating guns with the second production zone; triggering operation of the one or more perforating guns and thereby creating a plurality of perforations in the second production zone; axially aligning the pressure wave resonator with the plurality of perforations of the second production zone; actuating the pressure wave resonator and thereby emitting pressure waves that propagate radially outward and into the second production zone; and removing debris from the plurality of perforations of the second production zone with the pressure waves. Element 10: further comprising: removing the downhole assembly from the wellbore; hydraulically fracturing the second production zone via the plurality of perforations of the second production zone and thereby creating micro-fractures in the second production zone; reducing a fluid pressure within the wellbore; reintroducing the downhole assembly into the wellbore; axially aligning the pressure wave resonator with the second production zone; actuating the pressure wave resonator and thereby emitting pressure waves that propagate radially outward and into the micro-fractures of the second production zone; and removing debris from the micro-fractures of the second production zone with the pressure waves. Element 11: wherein the wellbore is lined with casing and creating the plurality of perforations in the second production zone comprises defining the plurality of perforations in the casing. Element 12: wherein the wellbore is an open-hole wellbore and creating the plurality of perforations in the second production zone comprises defining the plurality of perforations in an inner wall of the wellbore. Element 13: wherein setting the plug within the wellbore isolates the second production zone from the first production zone. Element 14: wherein actuating the pressure wave resonator comprises emitting ultrasound pressure waves at a frequency of 20 Hz or greater. Element 15: wherein conveying the downhole assembly into the wellbore comprises, conveying the downhole assembly into the wellbore on a conveyance selected from the group consisting of wireline, slickline, coiled tubing, production tubing, and any combination thereof. Element 16: wherein the pressure wave resonator is selected from the group consisting of a plasma pulse device, a pressure pulse generator, an ultrasound generator, and a high-pulse power generator, and any combination thereof.

Element 17: wherein the pressure wave resonator is selected from the group consisting of a plasma pulse ultrasonic device, a pressure pulse generator, an ultrasound generator, a high-pulse power generator, and any combination thereof. See other generators mentioned above.

By way of non-limiting example, exemplary combinations applicable to A, B and C include: Element 1 with Element 2; Element 2 with Element 3; Element 9 with Element 10; Element 9 with Element 11; Element 9 with Element 12; and Element 9 with Element 13.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore stimulation operation method, comprising:

conveying a downhole assembly into a wellbore including a production zone, the downhole assembly including one or more perforating guns and a pressure wave resonator;

axially aligning the one or more perforating guns with the production zone;

triggering operation of the one or more perforating guns and thereby creating a plurality of perforations in the production zone;

axially aligning the pressure wave resonator with the plurality of perforations;

actuating the pressure wave resonator and thereby emitting pressure waves that propagate radially outward and into the production zone; and removing debris from the plurality of perforations with the pressure waves.

2. The method of claim 1, further comprising:

removing the downhole assembly from the wellbore;

fracturing the production zone via the plurality of perforations and thereby inducing micro-fractures in the production zone;

reintroducing the downhole assembly into the wellbore;

axially aligning the pressure wave resonator with the production zone;

actuating the pressure wave resonator and thereby emitting pressure waves that propagate radially outward and into the micro-fractures; and removing debris from the micro-fractures with the pressure waves.

3. The method of claim 2, wherein the production zone is a first production zone and the downhole assembly further includes a plug arranged at a distal end of the downhole assembly and operatively coupled to a plug setting tool, the method further comprising:

moving the downhole assembly uphole from the first production zone;

actuating the plug setting tool and thereby setting the plug within the wellbore uphole from the first production zone;

axially aligning the one or more perforating guns with a second production zone included in the wellbore;

triggering operation of the one or more perforating guns and thereby a creating plurality of perforations in the second production zone;

axially aligning the pressure wave resonator with the plurality of perforations of the second production zone;

actuating the pressure wave resonator and thereby emitting pressure waves that propagate radially outward and into the second production zone; and removing debris from the plurality of perforations of the second production zone with the pressure waves.

4. The method of claim 3, wherein setting the plug within the wellbore isolates the second production zone from the first production zone.

5. The method of claim 1, wherein the wellbore is lined with casing and creating the plurality of perforations in the production zone comprises defining the plurality of perforations in the casing.

6. The method of claim 1, wherein the wellbore is an open-hole wellbore and creating the plurality of perforations in the production zone comprises defining the plurality of perforations in an inner wall of the wellbore.

7. The method of claim 1, wherein actuating the pressure wave resonator comprises emitting ultrasound pressure waves at a frequency of 20 Hz or greater.

8. The method of claim 1, wherein the pressure wave resonator is selected from the group consisting of a plasma pulse device, a pressure pulse generator, an ultrasound generator, and a high-pulse power generator, and any combination thereof.

9. The method of claim 1, wherein conveying the downhole assembly into the wellbore comprises, conveying the downhole assembly into the wellbore on a conveyance selected from the group consisting of wireline, slickline, coiled tubing, production tubing, and any combination thereof.

10. A wellbore stimulation operation method, comprising:

hydraulically fracturing a production zone of a wellbore and thereby creating micro-fractures in the production zone;

reducing a fluid pressure within the wellbore and subsequently conveying a downhole assembly including a pressure wave resonator into the wellbore;

axially aligning the pressure wave resonator with the production zone;

actuating the pressure wave resonator and thereby emitting pressure waves that propagate radially outward and into the micro-fractures; and removing debris from the micro-fractures with the pressure waves.

11. The method of claim 10, wherein the production zone is a first production zone and the downhole assembly further includes a plug arranged at a distal end of the downhole assembly and operatively coupled to a plug setting tool, and one or more perforating guns, the method further comprising:

moving the downhole assembly uphole from the first production zone;

actuating the plug setting tool and thereby setting the plug within the wellbore uphole from the first production zone;

axially aligning the one or more perforating guns with the second production zone;

triggering operation of the one or more perforating guns and thereby creating a plurality of perforations in the second production zone;

axially aligning the pressure wave resonator with the plurality of perforations of the second production zone;

actuating the pressure wave resonator and thereby emitting pressure waves that propagate radially outward and into the second production zone; and removing debris from the plurality of perforations of the second production zone with the pressure waves.

12. The method of claim 11, further comprising:

removing the downhole assembly from the wellbore;

hydraulically fracturing the second production zone via the plurality of perforations of the second production zone and thereby creating micro-fractures in the second production zone;

reducing a fluid pressure within the wellbore;

reintroducing the downhole assembly into the wellbore;

axially aligning the pressure wave resonator with the second production zone;

actuating the pressure wave resonator and thereby emitting pressure waves that propagate radially outward and into the micro-fractures of the second production zone; and removing debris from the micro-fractures of the second production zone with the pressure waves.

13. The method of claim 11, wherein the wellbore is lined with casing and creating the plurality of perforations in the second production zone comprises defining the plurality of perforations in the casing.

14. The method of claim 11, wherein the wellbore is an open-hole wellbore and creating the plurality of perforations in the second production zone comprises defining the plurality of perforations in an inner wall of the wellbore.

15. The method of claim 11, wherein setting the plug within the wellbore isolates the second production zone from the first production zone.

16. The method of claim 10, wherein actuating the pressure wave resonator comprises emitting ultrasound pressure waves at a frequency of 20 Hz or greater.

17. The method of claim 10, wherein conveying the downhole assembly into the wellbore comprises, conveying the downhole assembly into the wellbore on a conveyance selected from the group consisting of wireline, slickline, coiled tubing, production tubing, and any combination thereof.

18. The method of claim 10, wherein the pressure wave resonator is selected from the group consisting of a plasma pulse device, a pressure pulse generator, an ultrasound generator, and a high-pulse power generator, and any combination thereof.

19. A downhole assembly for undertaking a wellbore stimulation operation, comprising:

one or more perforating guns; and a pressure wave resonator operatively coupled to the one or more perforating guns, wherein the downhole assembly is conveyable into a wellbore on a conveyance to axially align the one or more perforating guns with a production zone to create a plurality of perforations in the production zone, and wherein the pressure wave resonator is axially alignable with the plurality of perforations and configured to emit pressure waves that propagate radially outward and into the production zone to remove debris from the plurality of perforations.

20. The downhole assembly of claim 19, wherein the pressure wave resonator is selected from the group consisting of a plasma pulse ultrasonic device, a pressure pulse generator, an ultrasound generator, a high-pulse power generator, and any combination thereof, See other generators mentioned above.

* * * * *